US010823091B2

(12) United States Patent
Kim

(10) Patent No.: US 10,823,091 B2
(45) Date of Patent: Nov. 3, 2020

(54) METHOD FOR CONTROLLING LOW-PRESSURE FUEL PUMP AND FUEL SUPPLY SYSTEM THEREFOR

(71) Applicants: HYUNDAI MOTOR COMPANY, Seoul (KR); KIA MOTORS CORPORATION, Seoul (KR)

(72) Inventor: Yong-Sik Kim, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/415,571

(22) Filed: May 17, 2019

(65) Prior Publication Data

US 2020/0018245 A1 Jan. 16, 2020

(30) Foreign Application Priority Data

Jul. 12, 2018 (KR) ..... 10-2018-0081160

(51) Int. Cl.

| | |
|---|---|
| ***F02D 19/02*** | (2006.01) |
| ***F02D 41/30*** | (2006.01) |
| *F02D 41/14* | (2006.01) |

(52) U.S. Cl.
CPC ..... *F02D 19/028* (2013.01); *F02D 41/3005* (2013.01); *F02D 2041/1423* (2013.01); *F02D 2200/0625* (2013.01)

(58) Field of Classification Search
CPC .... F02D 19/02; F02D 19/028; F02D 41/3005; F02D 2041/1423; F02D 2200/0625
See application file for complete search history.

(56) References Cited

U.S. PATENT DOCUMENTS 9,523,325 B2 * 12/2016 Koo ..... F02D 41/221
9,523,334 B2 * 12/2016 Cho ..... F02M 59/20

FOREIGN PATENT DOCUMENTS

KR 10-2013-0060616 A 6/2013

* cited by examiner

*Primary Examiner* — Hieu T Vo
(74) *Attorney, Agent, or Firm* — Brinks Gilson & Lione

(57) ABSTRACT

A method of controlling a low-pressure fuel pump may include: identifying a fuel consumption amount of the low-pressure fuel pump in response to a feedforward fuel control; determining a motor driving base duty based on the fuel consumption amount; and identifying a target fuel pressure based on the pressure of fuel.

11 Claims, 5 Drawing Sheets

CASE1) $q_{in} < q_{out} \rightarrow \Delta p < 0$

CASE2) $q_{in} = q_{out} \rightarrow \Delta p = 0$

CASE3) $q_{in} > q_{out} \rightarrow \Delta p > 0$

METHOD FOR CONTROLLING LOW-PRESSURE FUEL PUMP AND FUEL SUPPLY SYSTEM THEREFOR

CROSS-REFERENCE TO RELATED APPLICATION

This application claims priority to and the benefit of Korean Patent Application No. 10-2018-081160, filed on Jul. 12, 2018, the entire contents of which are incorporated herein by reference.

FIELD

The present disclosure relate to a method of controlling a low-pressure fuel pump to reduce fuel consumption and a fuel supply system implementing the method.

BACKGROUND

The statements in this section merely provide background information related to the present disclosure and may not constitute prior art.

In a fuel supply system such as a gasoline direct injection engine that is required to inject fuel into a combustion chamber at high pressure, compatibility between an optimum point of fuel efficiency and stability of fuel supply is very important.

For example, it is required to minimize a fuel consumption amount so as to improve fuel efficiency in order to accomplish the optimum point of fuel efficiency, whereas it is required to increase a fuel supply amount so as to prevent engine hesitation and engine stall in order to accomplish the stability of fuel supply. Therefore, the optimum point of fuel efficiency and the stability of fuel supply come into conflict with each other and thus compatibility between the two is a technically difficult problem.

This causes the fuel supply system to have no choice but to put the stability of fuel supply in superiority.

The reason for this is that the fuel supply system is composed of a high-pressure fuel pump that generates a fuel injection pressure of about 30 to 200 bar and a low-pressure fuel pump that generates a fuel pumping pressure of about 3 to 6 bar and that a low-pressure line of the low-pressure fuel pump always has a risk of generating cavities or bubbles associated with a saturated vapor pressure of fuel.

Therefore, the fuel supply system adopts a control mode of raising target pressure of the low-pressure fuel pump in order to ensure stability of fuel supply. The control mode of raising target pressure contributes to resolving causes of a phenomenon in which pressure is lowered below a saturated vapor pressure of the low-pressure line due to instantaneous overconsumption of fuel, a phenomenon in which a saturated vapor pressure changes due to insufficient correction of fuel temperature and generation of cavities or bubbles due to no reflection of fuel properties depending on the degree of volatilization of fuel and the degree of content of alcohol.

Accordingly, if the fuel supply system controls the low-pressure fuel pump in the control mode of raising target pressure, the gasoline direct injection engine can be operated without possibility of causing engine hesitation and engine stall.

However, we have discovered that there is a problem in the control mode of raising target pressure of the low-pressure fuel pump in that fuel consumption is large and thus fuel efficiency is deteriorated because a final mapping point having a high margin compared with an ideal optimum point of a saturation vapor pressure at which fuel can be maintained in a liquid state is applied in the control mode which is a saturated vapor pressure diagram of pressure versus temperature for fuel.

SUMMARY

The present disclosure provides a method of controlling a low-pressure fuel pump in a manner of reducing fuel consumption whereby a better compatibility with improved fuel efficiency and stability of fuel supply, which generally come into conflict with each other, can be accomplished by applying a fuel consumption amount as a control variable. Moreover, it is possible to secure the stability of fuel supply by inhibiting or preventing generation of cavities or bubbles in a state where fuel consumption for obtaining an optimum point of fuel efficiency is minimized or significantly reduced.

Other objects and advantages of the present disclosure can be understood by the following description and become apparent with reference to the forms of the present disclosure. Also, it is obvious to those skilled in the art to which the present disclosure pertains that the objects and advantages of the present disclosure can be realized by the means as claimed and combinations thereof.

In accordance with one aspect of the present disclosure, a method of controlling a low-pressure fuel pump to reduce or minimize fuel consumption comprises: controlling settings of a low-pressure fuel pump according to operation of an engine in response to feedforward control of a fuel consumption amount; controlling correction to the low-pressure fuel pump according to pressure of fuel; and controlling supply of fuel which is injected from an injector.

The controlling settings of a low-pressure fuel pump may comprise: identifying operation of the engine; identifying fuel consumption amount where the fuel consumption amount is considered as a feedforward control variable; determining a motor driving base duty for driving a motor; and identifying a target fuel pressure for accomplishing stability of fuel supply and an optimum point of fuel efficiency.

The identifying a fuel consumption amount and the identifying a target fuel pressure may be performed through a controller area network (CAN) communication.

The determining a motor driving base duty may be performed by the feedforward controller, and a fuel consumption amount is set in accordance with a flow rate signal of injected fuel that is received by the feedforward controller and is identified, and then a value of the motor driving base duty is generated.

The identifying a target fuel pressure can be performed based on a fuel temperature model.

The controlling correction to a low-pressure fuel pump may comprise: measuring actual pressure of fuel; determining a correction duty for correcting driving of the motor; calculating a motor driving duty based on a correction amount; determining a final driving duty based on correction of output; and driving the motor based on the correction of output.

The measuring actual pressure of fuel may be performed by a pressure sensor.

In determining the correction duty, when a pressure difference resulting from subtracting the measured actual pressure of fuel from a target fuel pressure is greater than 0, a correction amount as a positive correction amount may be calculated by the following equation:

Correction amount $D1$=gain1×(target pressure−actual measured pressure).

In determining the correction duty, when a pressure difference resulting from subtracting the measured actual pressure of fuel from a target fuel pressure is less than 0, a correction amount as a negative correction amount may be calculated by the following equation:

Correction amount $D2$=gain2×(target pressure−measured actual pressure).

The motor driving duty is calculated by the following equation:

$$\text{Duty}(n)=\text{Duty}(n-1)+\text{correction amount}$$

The final driving duty is calculated by the following equation:

$$F\text{Duty}=\text{Duty}(n)+\text{correction amount of Dead Time}$$

In accordance with another aspect of the present disclosure, a fuel supply system may comprise: an engine control unit (ECU); a fuel pump controller receiving a target fuel pressure from the ECU; a low-pressure fuel pump for pumping out fuel at low pressure based on a fuel consumption amount as a feedforward control variable; a pressure sensor for detecting pumping pressure of the low-pressure fuel pump; a high-pressure fuel pump configured to receive a flow rate of fuel from the low-pressure fuel pump and to pump out the fuel at high pressure; and an injector configured to receive fuel from the high-pressure fuel pump and to inject the fuel.

The fuel pump controller may comprise: a feedforward controller receiving a flow rate signal of the injected fuel from the ECU; a proportional and integral (PI) controller receiving the target fuel pressure from the ECU; and a feedforward compensator for determining the final driving duty of a motor and transmitting a signal having a pulse width t to the low-pressure fuel pump.

The method of controlling the low-pressure fuel pump variably according to one form of the present disclosure makes it possible to control a fuel consumption amount to be reduced or minimized by applying the fuel consumption amount as a control variable, thereby improving fuel efficiency and ensuring stability of fuel supply.

Further, according to the present disclosure, it is possible to secure stability of fuel supply by resolving causes of generation of cavities or bubbles in the state where an optimum point of fuel efficiency is secured by minimizing the fuel consumption amount so that conflict between the optimum point of fuel efficiency and the stability of fuel supply, which was a problem in the conventional fuel supply system for a gasoline direct injection engine, is resolved and at the same time compatibility between the optimum point of fuel efficiency and the stability of fuel supply is accomplished.

It is to be understood that both the foregoing general description and the following detailed description of the present disclosure are exemplary and explanatory and are intended to provide further explanation of the disclosure as claimed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
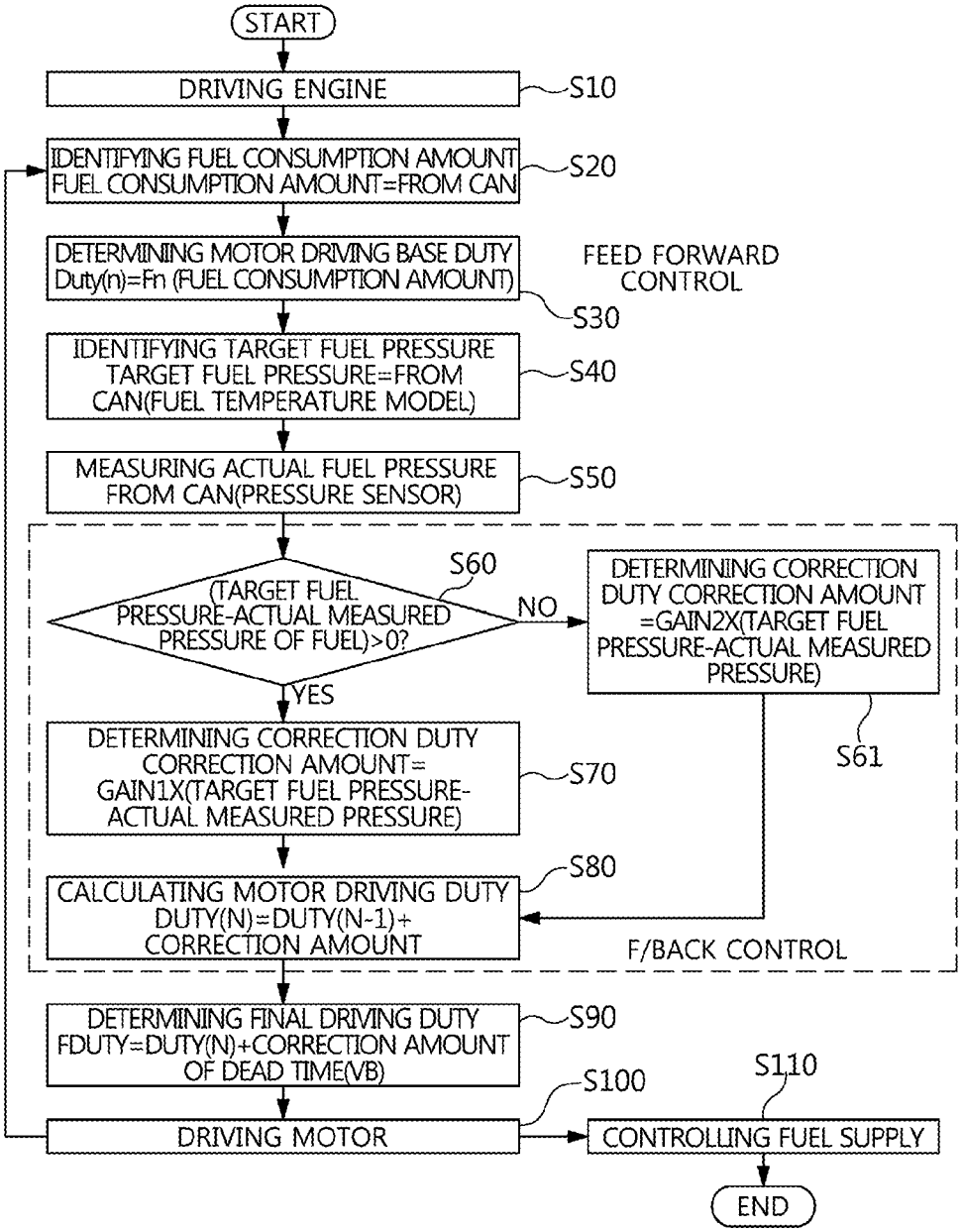
FIG. 1 is a flowchart illustrating a method for controlling a low-pressure fuel pump according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Exemplary forms described below are provided in order for those skilled in the art to easily understand the technical spirit of the present disclosure and the present disclosure is not limited thereto. In addition, contents represented in the accompanying drawings are diagrammed in order to easily describe exemplary forms of the present disclosure and may be different from configurations actually implemented.

It is to be understood that when a component is referred to as being coupled or connected to the other component, it may be directly coupled or connected to the other component but there may be another component interposed therebetween.

The term "connection" as used herein includes direct connection and indirect connection between a member and another member and may mean all physical connections such as adhesion, attachment, fastening, bonding and coupling.

In addition, the expressions such as "first," "second," etc. are used only to distinguish a plurality of components but not limit the order of the components or other features.

Singular expressions include plural expressions unless the context clearly indicates otherwise. The term "comprising" or "having" is intended to mean that there are features, numbers, steps, operations, components, parts, or combinations thereof described in the specification, and it may be interpreted that one or more other features, numbers, steps, operations, components, parts, or combinations thereof may be added thereto.

Referring to FIG. 1, a method of controlling a low-pressure fuel pump variably in a manner of minimizing fuel consumption comprises: controlling settings of the low-pressure fuel pump according to operation of an engine in response to feedforward control of a fuel consumption amount in steps S10 to S40; controlling correction to the low-pressure fuel pump according to pressure of fuel in steps S50 to S100; and controlling supply of fuel which is injected from an injector in step S110.

Particularly, in the steps S10 to S40 of controlling settings of a low-pressure fuel pump, the fuel consumption amount is considered as a feedforward control variable so that it is possible to reduce or minimize the fuel consumption amount for accomplishing an optimum point of fuel efficiency in a state where stability of fuel supply is provided without generation of cavities or bubbles. In this case, considering the fuel consumption amount as the control variable can reduce the fuel consumption amount desired to prevent engine hesitation and engine stall without having to increase the fuel supply as in conventional stability of fuel supply. In addition, the feedforward control determines the motor driving base duty to the fuel consumption amount before the target fuel pressure calculation, so that the fuel consumption is more efficiently reduced by considering the fuel consumption amount as the control variable unlike the feedback control which directly applied the target fuel pressure.

As a result, the method of controlling a low-pressure fuel pump makes it possible to control a fuel supply system with compatibility between an optimum point of fuel efficiency and stability of fuel supply, but without conflict between the optimum point of fuel efficiency and the stability of fuel supply that was a problem in the prior art.

Figure 2:
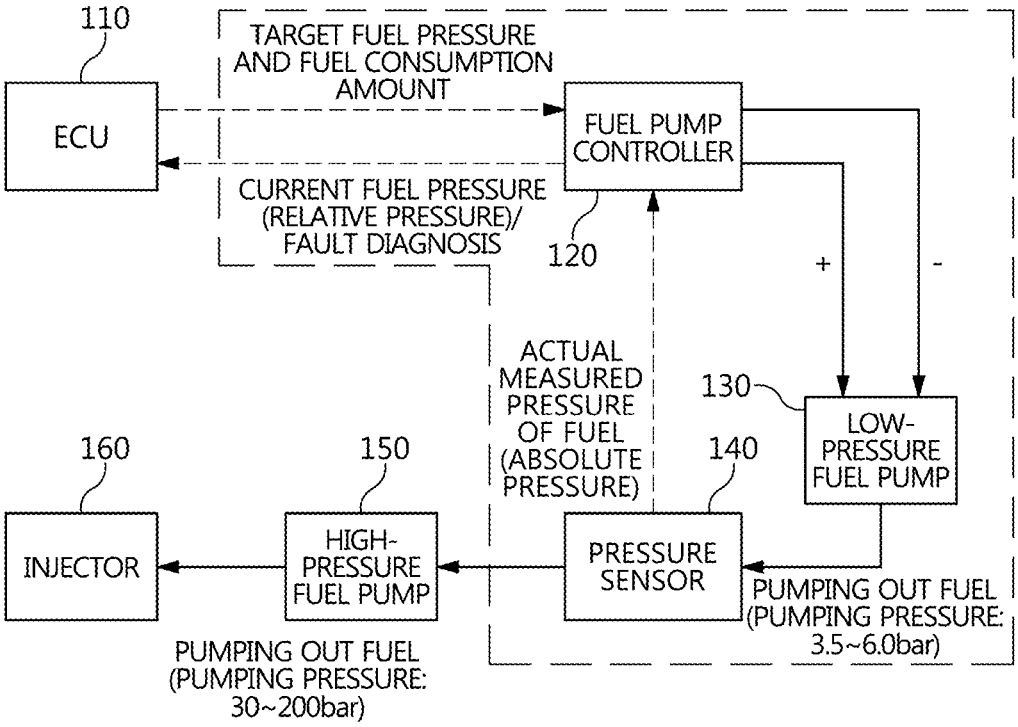
FIG. 2 is a schematic diagram of a fuel supply system in which a low-pressure fuel pump is controlled variably to reduce fuel consumption, according to one form of the present disclosure.

Referring to FIG. 2, the fuel supply system comprises an engine control unit (ECU) 110, a fuel pump controller 120, a low-pressure fuel pump 130, a pressure sensor 140, a high-pressure fuel pump 150 and an injector 160.

For example, the ECU 110 performs provision of a target fuel pressure (based on a fuel temperature model) and a fuel consumption amount, manages failure codes and operates a warning lamp wherein the ECU 110 supplies a target fuel pressure (relative pressure) to the fuel pump controller 120.

The fuel pump controller 120 performs driving of the pumps in response to the fuel consumption amount, receives fuel pressure feedback control and measured actual pressure (absolute pressure) of the pressure sensor 140 and performs conversion of the measured actual pressure to a relative pressure, real-time fault diagnosis and transmission of the result wherein the fuel pump controller 120 transfers the current fuel pressure (relative pressure) and fault diagnosis to the ECU 110.

The low-pressure fuel pump 130 is controlled by the fuel pump controller 120 and pumps out fuel (pumping pressure: 3.5 to 6.0 bar) taking into consideration of the fuel consumption amount as a feedforward control variable.

The pressure sensor 140 detects the pumping pressure of the low-pressure fuel pump 130 and transmits the detected pressure to the fuel pump controller 120.

The high-pressure fuel pump 150 receives a flow rate of fuel from the low-pressure fuel pump 130 and pumps out the fuel (pumping pressure: 30 to 200 bar).

The injector 160 injects the fuel pumping out from the high-pressure fuel pump 150 into a combustion chamber of an engine.

Hereinafter, the method for controlling a low-pressure fuel pump to reduce fuel consumption in one form of the present disclosure is described in detail with reference to FIGS. 3 to 5. In this case, the control subject is the fuel pump controller 120 associated with the ECU 110 while the controlled object is the low-pressure fuel pump 130. In addition, identifying the fuel consumption amount, identifying the target fuel pressure and measuring the actual fuel pressure may be performed through a controller area network (CAN) communication. The CAN communication is a standard communication protocol designed for microcontrollers or devices to communicate with each other without a host computer in a vehicle.

The steps S10 to S40 of controlling settings of the low-pressure fuel pump are performed by the fuel pump controller 120 where a step S10 of identifying operation of the engine, a step S20 of identifying the fuel consumption amount, a step S30 of determining a motor driving base duty and a step S40 of identifying the target fuel pressure are performed.

Figure 3:
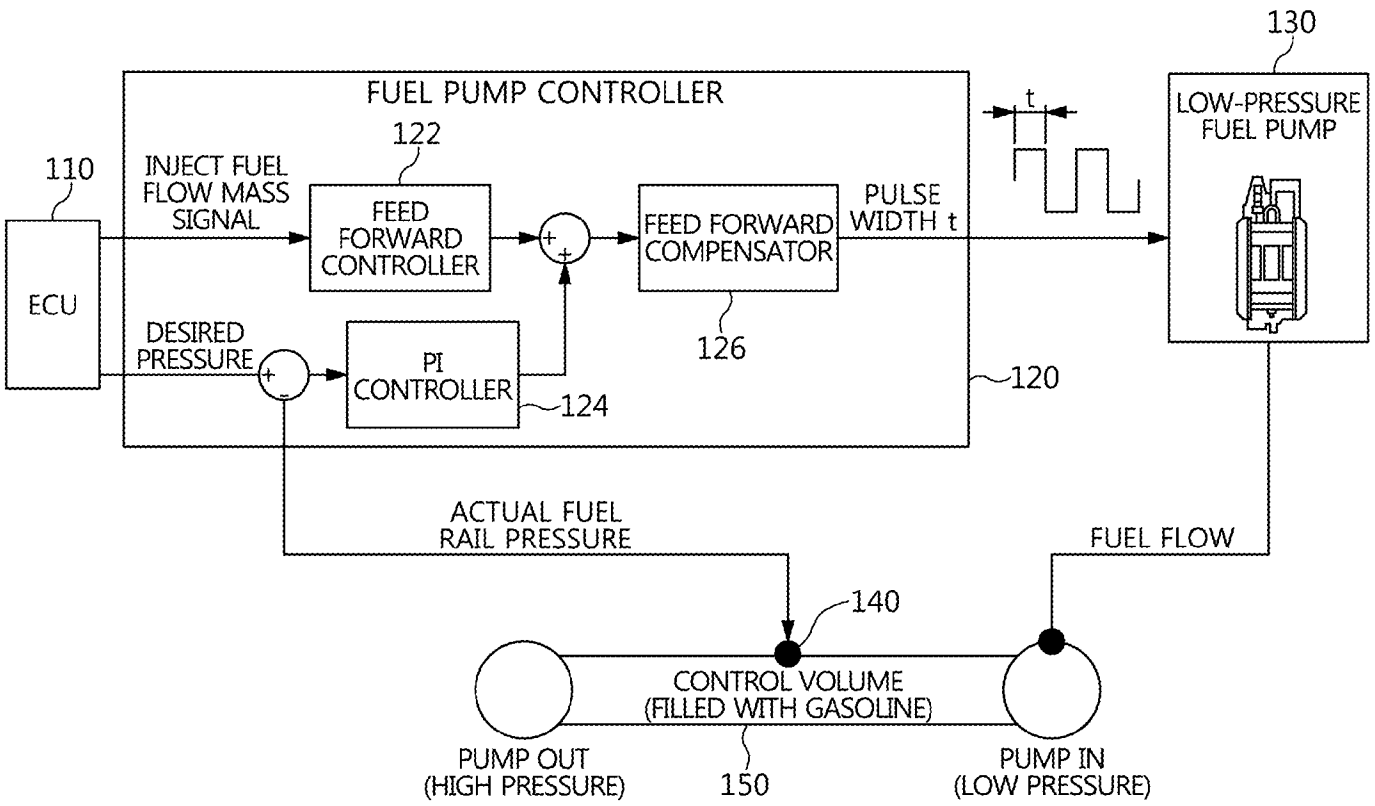
FIG. 3 is a diagram illustrating operation of a fuel supply system when a low-pressure fuel pump is controlled variably to reduce fuel consumption.

Referring to FIG. 3, the fuel pump controller 120 includes a feedforward controller 122, a proportional and integral (PI) controller 124 and a feedforward compensator 126 as components to perform a control logic for controlling the low-pressure fuel pump variably in a manner of minimizing fuel consumption wherein the feedforward controller 122, the proportional and integral (PI) controller 124 and the feedforward compensator 126 are configured with software together with hardware.

Specifically, the step S20 of identifying a fuel consumption amount is performed by the feedforward controller 122 after receiving a flow rate signal of the injected fuel from the ECU 110. The step S30 of determining a motor driving base duty is performed by the feedforward controller 122 where a fuel consumption amount set in accordance with a flow rate signal of injected fuel that is received by the feedforward controller is identified and then a value of the motor driving base duty of the low-pressure fuel pump 130 corresponding to the identified fuel consumption amount is generated. In this case, the value of the motor driving duty based on the fuel consumption amount is defined as a motor driving base duty.

Figure 4:
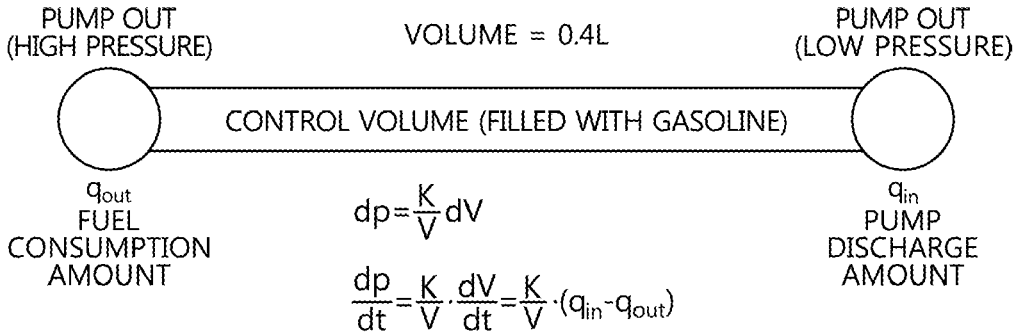
FIG. 4 is a diagram representing relationship between pressure and volume with respect to a fuel consumption amount of a low-pressure fuel pump constituting a fuel supply system.

Referring to FIG. 4, fuel efficiency can be improved by controlling a discharge amount of the low-pressure fuel pump based on the fuel consumption amount (fuel supply amount) in accordance with the following equation to prevent a pressure difference from being generated.

$$dp/dt=K/V\cdot dV/dt=K/V\cdot(q_{in}-q_{out})$$

Where p represents pressure, V represents volume, $q_{in}$ represents pump discharge amount, $q_{out}$ represents fuel consumption amount and K represents a constant.

Specifically, information of the fuel consumption amount is transmitted from the ECU 110 to the fuel pump controller 120 by means of the CAN communication to control the discharge amount of the low-pressure fuel pump.

In addition, applying a fuel temperature sensor or fuel temperature model for improving fuel efficiency while ensuring stability of fuel supply makes it possible to set the lowest pressure at which fuel can be maintained in a liquid for each temperature of the fuel. The fuel temperature model is a minimum pressure line at which fuel can be maintained in a liquid state.

Maintaining pressure of a low-pressure line above a saturated vapor pressure to apply the fuel temperature model makes it possible to maintain the fuel in a liquid state. The pressure of the low-pressure line is pressure of a pipe line wherein it maintains the minimum pressure maintaining the liquid state above the saturated vapor pressure.

The step S40 of identifying the target fuel pressure is performed by the PI controller 124 where the target fuel pressure is received from the ECU 110 and a proportional (P) duty value and an integral (I) duty value of the target fuel pressure are generated.

Figure 5:
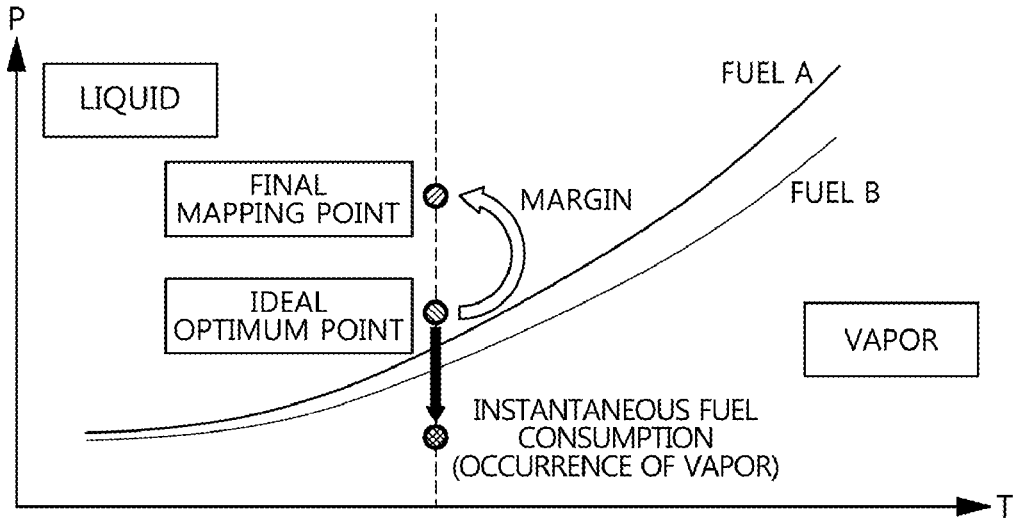
FIG. 5 is a saturated vapor pressure diagram applied in determining a target fuel pressure of a fuel temperature model constituting a fuel supply system.

Reference is now made to FIG. 5 which shows a graph illustrating how to apply a margin for preventing occurrence of bubbles of fuel due to instantaneous fuel consumption.

In this figure, saturated vapor pressure diagrams of fuels A and B which are the same fuel but have different temperatures are illustrated wherein the saturated vapor pressure diagram is known as representing the minimum pressure for maintaining gas in a liquid state. Where the x-axis, T represents absolute temperature and the y-axis, P represents pressure.

In the prior art, in order to prevent generation of bubbles of fuel, a final mapping point having an upward margin higher than an ideal optimum point of fuel in a liquid state is applied in controlling fuel such that fuel is prevented from changing into a gaseous state by the instantaneous fuel consumption but maintained in a liquid state. Therefore, there was a problem in that fuel efficiency is deteriorated due to a large fuel consumption amount.

However, the method of controlling the low-pressure fuel pump variably according to the present disclosure makes it possible to control a fuel consumption amount to be minimized by applying the fuel consumption amount as a control variable, thereby improving fuel efficiency and ensuring stability of fuel supply.

Here, it is noted that the motor driving base duty refers to a duty for driving a basic motor and the fuel temperature model is contemplated to minimize fuel consumption according to a fuel consumption amount with a pressure line maintaining fuel in a liquid state.

The fuel consumption amount and the target fuel pressure are identified using the final mapping point, the ideal mapping point and the target pressure margin. Here, it is noted that the final mapping point refers to a correction value of pressure for preventing fuel from changing from a liquid state to a gaseous state, the ideal mapping point refers to the lowest pressure at which fuel can be maintained in a liquid state and the target pressure margin refers to a pressure deviation within which range fuel can be prevented from changing from a liquid state to a gaseous state.

Specifically, the feedforward compensator 126 receives a sum value of a duty value of the fuel consumption amount and a PI duty value of the target fuel pressure, applies a compensation value to determine the final driving duty and then outputs a signal having a pulse width t to the low-pressure fuel pump 130.

Subsequently, the steps S50 to S100 of controlling correction of the low-pressure fuel pump are performed by the fuel pump controller 120 where a step S50 of measuring actual fuel pressure, a step S60 of determining a correction duty, a step S70 of determining a correction duty when a pressure difference resulting from subtracting the measured actual pressure from a target fuel pressure is greater than 0, a step S61 of determining a correction duty when a pressure difference resulting from subtracting the measured actual pressure from a target fuel pressure is less than 0, a step S80 of calculating a motor driving duty, a step S90 of calculating a final driving duty and a step S100 of driving the motor are performed.

Specifically, in the step S50 of measuring actual fuel pressure, the actual fuel pressure of the low-pressure fuel pump is measured by the pressure sensor 140 after the target fuel pressure is identified by the fuel pump controller 120. The measured actual pressure of fuel obtained by measuring the actual pressure of fuel refers to the measured fuel pressure with respect to atmospheric pressure (absolute pressure), which is also referred to as actual measured pressure. The fuel pump controller 120 converts the actual measured pressure of fuel with respect to relative pressure and then transmits the converted pressure to the ECU 110 and uses the converted pressure for performing fault diagnosis.

Next, in the step S60 of determining a correction duty, a driving duty for driving the motor is calculated wherein the correction duty is determined with a pressure difference resulting from subtracting the actual measured pressure of fuel from the target fuel pressure. Here, the correction duty is a correction duty for driving the motor, in which correction factors other than those for the motor are excluded. If the pressure difference resulting from subtracting the actual measured pressure of fuel from the target fuel pressure is greater than 0, the correction duty is obtained by the following equation in the step S70 of determining a correction duty.

$$\text{Correction amount } D1\text{(or positive correction amount)} = \text{gain1} \times \text{(target pressure} - \text{actual measured pressure)}$$

Where the gain1 represents a first correction constant.

On the contrary, when the pressure difference resulting from subtracting the actual measured pressure of fuel from the target fuel pressure is less than 0, the correction duty is obtained by the following equation in the step S61 of determining a correction duty.

$$\text{Correction amount } D2\text{(or negative correction amount)} = \text{gain2} \times \text{(target pressure actual measured pressure)}$$

Where the gain2 represents a second correction constant.

Thus, each of the correction amount D1 as a positive correction amount and the correction amount D2 as a negative correction amount has a characteristic that is increased by the pressure difference resulting from subtracting the actual measured pressure of fuel from the target fuel pressure or proportional to the pressure difference resulting from subtracting the actual measured pressure of fuel from the target fuel pressure, respectively. In the step S80 of calculating a motor driving duty, the motor driving duty is obtained with the correction amount obtained wherein the motor driving duty is obtained by the following equation.

$$\text{Duty}(n) = \text{Duty}(n-1) + \text{correction amount}$$

Thus, a new value of the motor driving duty is calculated by adding the correction amount D1 as a positive correction amount or the correction amount D2 as a negative correction amount to an old value (i.e., a previous value) of the motor driving duty. Subsequently, in the step S90 of determining the final driving duty, the final driving duty for driving the motor is determined and the motor is driven accordingly in the step S100 of driving the motor. The final driving duty is obtained by the following equation.

$$F\text{Duty} = \text{Duty}(n) + \text{correction amount of Dead Time}$$

Thus, the final motor driving duty is calculated by adding the correction amount of Dead Time to the new value of the motor driving duty. Where the Dead Time represents an elapsed time from a time when input changes to a time when change of output is detected. Therefore the elapsed time of the Dead Time can offset a dead band in which the low-pressure fuel pump 130 dose not physically response to the input of the motor driving duty. The correction amount of Dead Time represents a correction amount of the elapsed time from the time when input changes to the time when change of output is detected. This correction to the Dead Time makes it possible to perform precise control without delay. Therefore the correction amount of Dead Time compensates for the Dead Time so that the low-pressure fuel pump 130 can quickly response to the input of the final driving duty.

Then, the fuel pump controller 120 performs the step S110 of controlling supply of fuel. In the step S110 of controlling supply of fuel, supply of fuel is performed in a way that the low-pressure fuel pump 130 pumps out fuel to the high-pressure fuel pump 150 at low pressure and the high-pressure fuel pump 150 pumps out the fuel at high pressure and then the fuel is injected from the injector 160.

It will be understood by those skilled in the art that the present disclosure may be embodied in other specific forms without departing from the spirit or essential characteristics thereof. Therefore, it should be understood that the forms as described above are merely selected among various possible examples in order for those skilled in the art to understand the present disclosure and therefore the technical spirit of the present disclosure is not necessarily restricted or limited only by the forms provided and that various changes, additions and modifications may be made without departing from the spirit of the present disclosure and other forms equivalent thereto are possible. The scope of the present disclosure is defined by the appended claims rather than by the foregoing description and all changes or modifications derived from the meaning and scope of the claims and the equivalents thereof should be construed to be covered by the scope of the present disclosure. The terms and words used in the specification and claims are defined on the basis of the principle that the inventor can define the concept of a term appropriately in order to describe his/her own disclosure in the best way and should not be construed as only their ordinary or dictionary sense. In addition, it is natural that the order of configurations described in the foregoing description is not necessarily required to be performed in a time-series order and that although the order of carrying out each of the configurations or steps is changed, if this change fulfills the gist of the present disclosure, it will fall within the scope of the present disclosure.

What is claimed is:

1. A fuel supply system comprising:

an engine control unit (ECU) configured to determine a target fuel pressure based on a fuel temperature model;

a fuel pump controller configured to receive a target fuel pressure from the ECU;

a low-pressure fuel pump configured to pump out fuel at a low pressure based on a fuel consumption amount as a feedforward control variable;

a pressure sensor configured to detect a pumping pressure of the low-pressure fuel pump;

a high-pressure fuel pump configured to receive a flow rate of fuel from the low-pressure fuel pump and to pump out the fuel at a high pressure; and an injector configured to receive the fuel from the high-pressure fuel pump and to inject the fuel.

2. The fuel supply system according to claim 1, wherein the fuel pump controller comprises:

a feedforward controller configured to receive a flow rate signal of the injected fuel from the ECU;

a proportional and integral (P1) controller configured to receive the target fuel pressure from the ECU; and a feedforward compensator configured to determine a final driving duty of a motor and to transmit a signal having a pulse width t to the low-pressure fuel pump.

3. A method of controlling a low-pressure fuel pump, the method comprising:

identifying a fuel consumption amount of the low-pressure fuel pump in response to a feedforward fuel control;

determining a motor driving base duty based on the fuel consumption amount; and identifying a target fuel pressure based on a pressure of fuel, wherein identifying the fuel consumption amount and the target fuel pressure are performed through a controller area network (CAN) communication.

4. The method according to claim 3, wherein determining the motor driving base duty is performed by a feedforward controller, wherein the fuel consumption amount is based on a flow rate signal of injected fuel that is received by the feedforward controller is identified, and then a value of the motor driving base duty is generated.

5. The method according to claim 3, wherein identifying the target fuel pressure is performed based on a fuel temperature model.

6. The method according to claim 3, wherein identifying the fuel consumption amount of the low-pressure fuel pump comprises:

measuring an actual pressure of fuel;

determining a correction duty for correcting driving of a motor based on the measured actual pressure and the target fuel pressure of the fuel;

calculating a motor driving duty based on a correction amount;

determining a final driving duty based on a correction of an output; and driving the motor based on the final driving duty.

7. The method according to claim 6, wherein measuring the actual pressure of fuel is performed by a pressure sensor.

8. The method according to claim 6, wherein in determining the correction duty, when a pressure difference resulting from subtracting the measured actual pressure of fuel from the target fuel pressure is greater than 0, the correction amount as a positive correction amount is increased by the pressure difference or proportional to the pressure difference.

9. The method according to claim 6, wherein in determining the correction duty, when a pressure difference resulting from subtracting the measured actual pressure of fuel from the target fuel pressure is less than 0, the correction amount as a negative correction amount is increased by the pressure difference or proportional to the pressure difference.

10. The method according to claim 6, wherein a new value of the motor driving duty is calculated by adding the correction amount to an old value of the motor driving duty.

11. The method according to claim 6, wherein the final driving duty is calculated by adding a correction amount of Dead Time to the motor driving duty, wherein the correction amount of Dead Time is compensated for dead time in which the low-pressure fuel pump dose not respond to the motor driving duty.

* * * * *